United States Patent [19]

Weatherby

[11] Patent Number: 4,718,791

[45] Date of Patent: Jan. 12, 1988

[54] HIGH CAPACITY TIEBACK INSTALLATION METHOD

[75] Inventor: David E. Weatherby, Potomac, Md.

[73] Assignee: Schnabel Foundation Company, Bethesda, Md.

[21] Appl. No.: 29,045

[22] Filed: Mar. 23, 1987

Related U.S. Application Data

[63] Continuation of Ser. No. 798,621, Nov. 15, 1985.

[51] Int. Cl.[4] ..... E02D 29/00

[52] U.S. Cl. ..... 405/262; 405/258; 405/284

[58] Field of Search ..... 405/258, 262, 260, 284; 52/155–167

[56] References Cited

U.S. PATENT DOCUMENTS

| | | | |
|---|---|---|---|
| 3,359,742 | 12/1967 | Blatter | 405/260 |
| 3,436,923 | 4/1969 | Lagerstrom | 405/260 |
| 3,464,216 | 9/1969 | Turzillo | 405/239 |
| 3,491,497 | 1/1970 | Bauer | 52/166 |
| 3,492,823 | 2/1970 | Lamberton . | |
| 3,494,133 | 2/1970 | Ahlgren et al. | 405/260 |
| 3,494,134 | 2/1970 | Jorge . | |
| 3,665,717 | 5/1972 | Sweeney et al. | 405/260 |
| 3,753,354 | 8/1973 | Bauer . | |
| 3,815,368 | 6/1974 | Turzillo | 405/260 |
| 3,971,177 | 7/1976 | Endo | 52/166 |
| 3,973,409 | 8/1976 | Asayama | 405/260 |
| 4,000,623 | 1/1977 | Meardi . | |
| 4,253,781 | 3/1981 | Fischer et al. | 405/269 X |

OTHER PUBLICATIONS

Schnabel Foundation Company Six-Year Plan for Fiscal Year 1985–1986, Key Actions Cost Benefit Analysis.

*Primary Examiner*—Dennis L. Taylor

*Attorney, Agent, or Firm*—Banner, Birch, McKie & Beckett

[57] ABSTRACT

The present invention is directed to a method of installing a high-capacity tieback in coarse-grained soil. The method includes connecting a unitary hollow casing to a drill and inserting a prestressing steel tendon within the casing. A lost bit is affixed to one end of the casing. The drill and casing is positioned at the desired location of the tieback and the casing is inserted into the ground by rotating the casing with the drill. The bit is released and grout is pumped into the casing under high-pressure. Once the grout has reached the desired pressure, the casing is extracted by applying a high-torque of at least 12,000 ft.-lbs. to the casing with the drill which overcomes the frictional engagement between the grout and the casing, and by applying a pulling force with the drill.

9 Claims, 3 Drawing Figures

12
10
18
14
13
16

12
10
18
22
14
20
16

27
18
25
22
14
16

HIGH CAPACITY TIEBACK INSTALLATION METHOD

This application is a continuation of application Ser. No. 798,621, filed Nov. 15, 1985.

TECHNICAL FIELD

The present invention relates to a tieback installation method in coarse-grained soils. In particular, to a method wherein a one-piece casing, containing the tieback tendon, prestressing steel, is installed into the ground. Upon installing the casing to the desired length, grout is injected at a high pressure in excess of 150 psi through the casing fixing the prestressing steel to the ground as the casing is extracted. During extraction of the casing, high torque is applied to the casing to overcome the friction developed between the casing and the grout, so that a relatively moderate pulling force can be used to extract the casing.

BACKGROUND OF THE INVENTION

Earth tiebacks, also generally referred to as ground anchors, are often used in the construction industry to support or anchor various structures in the ground. For example, they are used to support retaining walls bordering highways or to support excavation sheeting to prevent cave-ins which would otherwise endanger lives and property. Such tiebacks generally comprise a prestressing steel tendon, fabricated from multi-element strands or a single bar, installed in the ground and secured at its outer end by an anchorhead to an excavation sheeting system or other structure to be supported. A cement grouted anchor is formed around the opposite distal end of the tendon to distribute to the surrounding soil forces applied to the tendon.

High load-carrying capacity tiebacks are made in coarse-grained soils by a variety of methods. Such high capacity tiebacks are installed by pumping cement grout under high pressure, for example, at a pressure above 150 psi, which anchors the prestressing steel (tieback tendon) to the ground. At such high grout pressure, water in the cement grout is quickly driven from the grout into the soil as the grout is pumped out the bottom of the casing. The cement particles in the grout remain creating very stiff grout surrounding the anchor tendon and the lower portion of the casing. This stiff, solidifying grout makes it difficult to withdraw the casing so that special techniques or methods have been developed to install high capacity tiebacks.

In one prior art method a drill is used to rotate the casing into the ground; and in another prior art method the casing is driven into the ground using a percussion hammer. The drilled casing uses a "lost" bit while the driven casing uses a "lost" point, attached to the front of the casing. After the casing has been installed to the desired depth, the prestressing steel is inserted into the casing and the bit or point is removed. Cement grout is then pumped down the casing while the casing is extracted with hydraulic jacks. The drills used to install tieback casings normally have about 4,000 to 6,000 ft.-lbs. of torque and 16,000 lbs. of pulling force. The casing-pulling jacks used to extract the casing must be capable of applying more than 50 tons of pulling force. These methods have the disadvantage of requiring two separate pieces of equipment, i.e., the dril or percussion hammer to install the casing and the jack and hydraulic power supply to withdraw the casing. Also, sectional casing must be used since the drills and percussion hammers are not capable of installing long continuous casing. Sectional casing is both more expensive and time consuming to use than a one piece casing. When sectional casing is used, bar tendons must be used because strand tendons have become grouted to the casing when high pressure is used to apply the grout.

Another method of installing high capacity tiebacks in sand has been attempted, but to date it has been unsuccessful. In this method the casing is drilled into the ground, to a desired depth. Thereafter, the prestressing steel is inserted into the casing. The anchor is grouted by pumping grout down the casing at high pressure as the drill attempts to extract the casing. In these attempts the drill has applied at torque of only approximately 6,000 ft.-lbs. This torque is not sufficient to overcome the friction developed between the casing and the grout placed under high pressure resulting in failure to extract the casing and thus a considerable amount of lost casing. This attempted method is therefore incapable of attaining high load-carrying capacity tiebacks.

A further prior method of installing a high-pressure-grouted anchor, disclosed in U.S. Pat. No. 3,494,134, consists of drilling a casing into the ground and inserting the prestressing steel along with a special grout pipe into the casing. In another prior technique, grout is placed around the prestressing steel under low pressure as the casing is extracted. The drill is capable of extracting the casing because the friction between the low pressure grout and the casing is low. After the initial low pressure applied grout has set (approximately 24 hours), grout is injected into the anchor zone portion of the tieback under high pressure through the special grout pipe. The high pressure grout fractures the low pressure grout surrounding the anchor. Then the tieback anchor is grouted under high pressure through the special grout pipe. This technique is time consuming since it requires two separate grout applications with an extended time interval between applications. An additional component, the special grout pipe, is also required, as well as a larger hole.

SUMMARY OF THE INVENTION

The present invention is directed to a method of installing a high capacity tieback in coarse-grained soils. A unitary hollow casing is connected to a drill. Prestressing steel is inserted within the casing and a lost bit is affixed to one end of the casing. The drill and casing is then positioned in the desired location and the casing is rotated into the ground by the drill and drilling fluid such as air, water, or the like, removes the soil as the casing is advanced. Once the casing has been drilled to the desired depth, the bit is released and grout is pumped down the casing. After the grout pressure has reached a desired high level (greater than 150 psi), the casing is extracted by applying a torque of at least 12,000 ft.-lbs. on the casing with the drill to overcome the frictional engagement between the grout and the casing and by applying a pulling force generally along the axis of the casing with the drill.

The inability to extract the casing in prior art methods resulted because the high grout application pressure created semi-solid grout surrounding the end of the casing which caused significant friction between the casing and the grout. Once the grout seized the casing, it was not possible to free the casing with the drill. In the present invention, the application of high torque enables the casing to be extracted due to the combination of the high torque and a relatively moderate pulling force applied by a single drill. The high torque breaks the friction between the semi-solid cement grout and the casing and then the casing may be extracted with the drill. The method of the present invention allows tiebacks to be installed which have a high unit load-carrying capacity of at least 9,000 lbs/linear foot of anchor.

The present invention overcomes the disadvantages of the prior art methods discussed above by providing a method in which the casing may be easily extracted using one piece of equipment. Moreover, the casing may be installed in a single piece, so that the prestressing steel may be inserted into the casing prior to drilling. This is a significant improvement over other methods which use short-length casing sections. Using short-length casing sections requires that all the casing be installed before the prestressing steel can be inserted and requires the use of a bar tendon as the prestressing steel when high grout pressures are used. Since the one piece casing can be extracted in a continuous operation, multi-strand tendons can be used without grouting them inside the casing. The capability of using multi-strand tendons in high pressure grouted tiebacks where the pressure is applied to the grout through the casing is a significant advantage over prior art methods because multi-strand tendons can have higher load-carrying compacities and they are available in longer lengths than bar tendons. In the United States, bar tendons have an ultimate load-carrying capacity of 234,000 pounds and a maximum uncoupled length of 60 feet. Additionally, there is a significant advantage in using a one-piece casing which does not have joints and may be fabricated from tubing which is heavier and larger than the tubing used in conventional sectional casing, since the casing joints used with existing methods are very expensive and the weight of the casing is limited to what two people can carry.

DETAILED DESCRIPTION OF THE INVENTION

Figure 1:
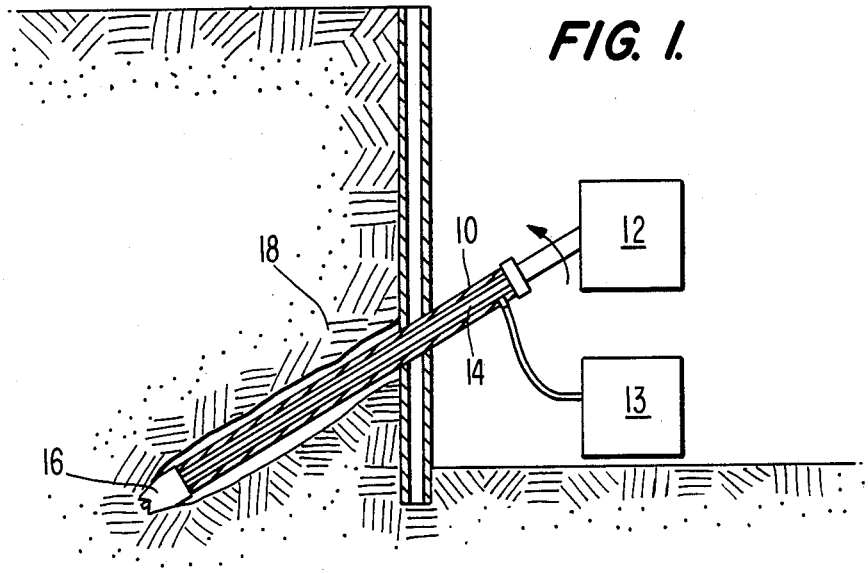
FIG. 1 is a diagrammatic cross-sectional side view illustrating a unitary casing being installed in accordance with the present invention.

A preferred method of installing a high capacity tieback in accordance with the present invention includes connecting a unitary hollow casing 10 to a drill 12, which is shown diagrammatically as a block. Drill 12 is a high-torque drill capable of providing a torque of at least 12,000 ft.-lbs. and preferably higher. Drill 12 also provides a pulling force of at least 16,000 lbs. A prestressing steel tendon 14 is inserted within casing 10 from its bottom end, and a lost bit 16 is then fixed to the bottom end of casing 10 which is to be drilled into ground 18. Drill 12 and casing 10 are positioned at the desired location of the tieback. Casing 10 then is rotated by drill 12 into the ground while a drilling fluid such as air, water, or the like, is injected by a pump 13 to remove the soil as casing 10 is advanced.

Figure 2:
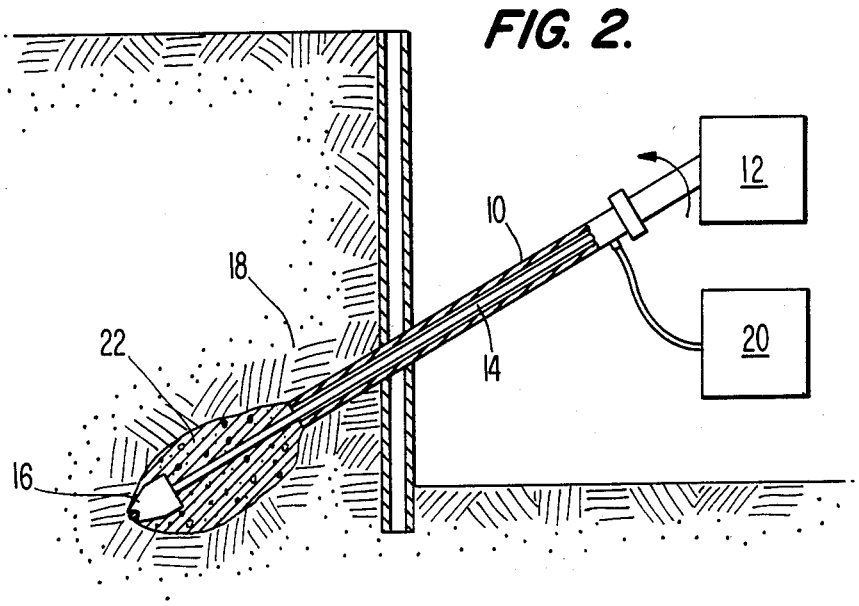
FIG. 2 is a diagrammatic cross-sectional side view illustrating the unitary casing being extracted and grout being pumped in accordance with the present invention.

As shown in FIG. 2, once casing 10 has been drilled into the ground to the desired depth, lost bit 16 is released and grout 22 is pumped down casing 10 under high-pressure by a pump 20, shown diagrammatically as a block. Once the pressure under which grout 22 is being pumped reaches the desired high level, wherein water in the grout is forced to bleed from the grout typically at a pressure of at least 150 psi, drill 12 extracts casing 10. As water bleeds from grout 22, solidified grout is formed adjacent the casing end. Grout 22 must be capable of allowing such water bleed at high pressure. A hydraulic cement type grout is suitable. Drill 12 applies a torque of at least 12,000 ft.-lbs. to casing 10 which overcomes the frictional engagement between solidifying grout 22 and casing 10. Drill 12 simultaneously applies a moderate amount of pulling force, typically no more than 16,000 lbs. to the casing 10 generally along its axis. Grout 22, when it solidifies forms an anchor around the distal end of prestressing steel tendon 14. This grouted anchor, over length 25, is shown attached to a support structure 27 in FIG. 3.

In a preferred method, the tendon 14 will be a multi-element tendon fabricated from seven-wire prestressing steel strand. The present method permits a multi-element strand tendon to be used and high pressure grouted with its inherent advantages of longer lengths and higher potential ultimate load-carrying capacity. Alternatively, the prestressing steel tendon can be formed of a bar.

The preferred method is optimally utilized when installing a tieback in coarse-grained soil having a penetration resistance of at least ten (10) blows per foot, as defined by ASTM D-1586, "Standard Method for Penetration Test and Split-Barrel Sampling of Soils". The permeability of the coarse-grained soil is greater than $10^{-4}$ cm/second, as defined by ASTM D-2434, "Standard Test Method for Permeability of Granular Soils (Constant Head)".

Figure 3:
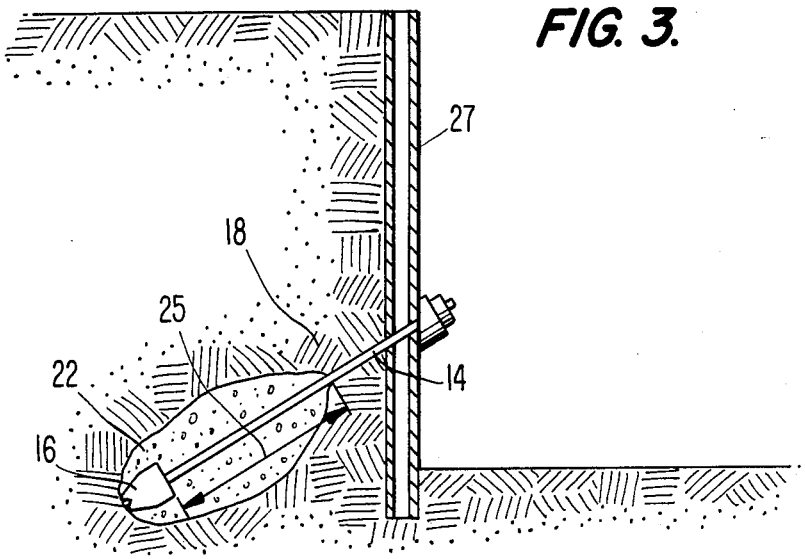
FIG. 3 is a diagrammatic cross-sectional side view illustrating an installed tieback.

After casing 10 is extracted, prestressing steel tendon 14 is anchored to a supporting structure as shown in FIG. 3. The installed tieback in accordance with the present invention creates a tieback with an ultimate load-carrying capacity of at least 140,000 pounds and a high unit load-carrying capacity of at least 9,000 lbs/linear foot of grouted anchor. As used herein, high load-carrying capacity tiebacks refers to this high unit load-carrying capacity. The unit load-carrying capacity of tiebacks installed by the present invention typically reach the 20,000 to 30,000 lbs/linear foot of grout anchor ranges. While low pressure grouted, tiebacks can be constructed with a high ultimate load-carrying capacity, the length of the tiebacks would have to be significantly greater than a high pressure grouted, tiebacks with the same ultimate load-carrying capacity. Moreover, the method is significantly faster than other methods used and the equipment used overcomes the difficulty associated with grouting under high pressure and attempting to pull casing with low-torque drills. It is believed that grouting under high pressure results in high capacity tiebacks because the state of stress surrounding the tiebacks is significantly changed, resulting in high frictional forces between the grout and the surrounding soil.

The detailed description of the method of the invention is for illustrative purposes only and modifications may be obvious to one of ordinary skill in the art, within the scope of the invention as defined by the broad general meaning of the terms in which the appended claims are expressed.

I claim:

1. A method of installing a high capacity tieback comprising:

connecting a unitary hollow casing to a drill;

inserting prestressing steel within the casing;

fixing a lost bit to one end of the casing;

positioning the drill and casing at the desired location of the tieback;

rotating the casing into the ground with the drill and removing soil with a drilling fluid as the casing is advanced into the ground;

releasing the bit from the casing and pumping grout down the hollow interior of the casing at a pressure of at least 150 psi forcing water in the grout to bleed from the grout;

extracting the casing from the ground by developing a torque of at least 12,000 ft./lbs on the casing with the drill to overcome the frictional engagement between the grout and the casing and by applying a pulling force to the casing generally along the axis of the casing with the drill; and anchoring the prestressing steel.

2. A method as in claim 1 wherein the pulling force applied by the drill is potentially at least 16,000 lbs.

3. A method as in claim 1 including forming solified grout adjacent the casing end in the ground as the water bleeds from the solidifying grout during the extracting step.

4. A method as in claim 1 wherein the casing is drilled into coarse-grained soil having a penetration resistance of at least ten blows per foot and a permeability greater than $10^{-4}$ cm/second.

5. A method as in claim 1 wherein the installed tieback has a ultimate load-carrying capacity of at least 70 tons.

6. A method as in claim 1 wherein the installed tieback has a unit load-carrying capacity of at least 9,000 lbs/linear foot of grouted anchor in the ground.

7. A method as in claim 1 wherein said prestressing steel inserted in the ground is formed of a multi-element tendon fabricated from seven-wire prestressing steel strand.

8. A method as in claim 1 wherein said prestressing steel inserted in the ground is a bar.

9. A method of installing a high capacity tieback comprising:

connecting a unitary hollow casing to a drill;

inserting prestressing steel within the casing;

fixing a lost bit to one end of the casing;

positioning the drill and casing at the desired location of the tieback;

rotating the casing into coarse-grained soil having a penetration resistance of at least ten blows per foot and a permeability greater than $10^{-4}$ cm/second with the drill and removing soil with a drilling fluid as the casing is advanced into the ground;

releasing the bit from the casing and pumping grout down the hollow interior of the casing at a pressure of at least 150 psi forcing water in the grout to bleed from the grout and forming solidified grout adjacent to the casing end in the ground during the extracting step;

extracting the casing from the coarse-grained soil by applying a torque of at leat 12,000 ft.-lbs. to the casing with the drill to overcome the frictional engagement between the solidifying grout and the casing, and by applying a pulling force to the casing generally along the axis of the casing with the drill; and anchoring the prestressing steel to form a tieback having a unit load-carrying capacity of at least 9,000 lbs/linear foot of grouted anchor in a coarse-grained soil.

* * * * *